US009488340B2

(12) United States Patent
Van Bommel et al.

(10) Patent No.: US 9,488,340 B2
(45) Date of Patent: Nov. 8, 2016

(54) ADJUSTABLE LIGHT EMITTING ARRANGEMENT FOR ENHANCEMENT OR SUPPRESSION OF COLOR USING A WAVELENGTH CONVERTING MEMBER AND A NARROW BAND REFLECTOR

(71) Applicant: KONINKLIJKE PHILIPS N.V., Eindhoven (NL)

(72) Inventors: Ties Van Bommel, Horst (NL); Rifat Ata Mustafa Hikmet, Eindhoven (NL); Dirk Jan Van Kaathoven, Eindhoven (NL); Martinus Petrus Joseph Peeters, Weert (NL)

(73) Assignee: KONINKLIJKE PHILIPS ELECTRONICS N.V., Eindhoven (NL)

( * ) Notice: Subject to any disclaimer, the term of this patent is extended or adjusted under 35 U.S.C. 154(b) by 99 days.

(21) Appl. No.: 14/384,032

(22) PCT Filed: Feb. 28, 2013

(86) PCT No.: PCT/IB2013/051600

§ 371 (c)(1),
(2) Date: Sep. 9, 2014

(87) PCT Pub. No.: WO2013/132394

PCT Pub. Date: Sep. 12, 2013

(65) Prior Publication Data

US 2015/0049458 A1 Feb. 19, 2015

Related U.S. Application Data

(60) Provisional application No. 61/608,705, filed on Mar. 9, 2012.

(51) Int. Cl.
*F21V 14/04* (2006.01)
*F21V 14/00* (2006.01)

(Continued)

(52) U.S. Cl.
CPC ..... *F21V 14/04* (2013.01); *F21K 9/56* (2013.01); *F21V 9/08* (2013.01); *F21V 13/02* (2013.01);

(Continued)

(58) Field of Classification Search
CPC ..... F21V 14/04; F21V 9/08; F21V 13/02; F21V 14/003; F21V 13/08; F21V 14/006; F21K 9/56
See application file for complete search history.

(56) References Cited

U.S. PATENT DOCUMENTS

2008/0231162 A1 9/2008 Kurihara
2008/0265749 A1 10/2008 Bechtel (Continued)

FOREIGN PATENT DOCUMENTS

DE 102007022090 A1 11/2008
DE 102009034250 A1 1/2011
WO WO2009087583 A1 7/2009
WO WO2010035171 A2 4/2010

(Continued)

*Primary Examiner* — Joseph L Williams

(57) ABSTRACT

A color-adjustable light emitting arrangement is provided. The arrangement includes a solid-state light source adapted to emit light of a first wavelength range; a wavelength converting member arranged to receive light emitted by the light source and capable of converting light of the first wavelength range into visible light of a second wavelength range; and a narrow band reflector arranged in a light output direction from the wavelength converting member to receive light of the second wavelength range, the narrow band reflector being reversibly switchable between a first state in which the narrow band reflector reflects a first sub-range of the second wavelength range, and a second state in which narrow band reflector reflects a second sub-range of the second wavelength range.

13 Claims, 6 Drawing Sheets

(51) Int. Cl.

| | |
|---|---|
| ***F21V 9/08*** | (2006.01) |
| ***F21V 13/02*** | (2006.01) |
| ***F21V 13/08*** | (2006.01) |
| ***F21K 99/00*** | (2016.01) |
| *F21Y 101/02* | (2006.01) |

(52) U.S. Cl.
CPC ..... *F21V 13/08* (2013.01); *F21V 14/003* (2013.01); *F21V 14/006* (2013.01); *F21Y 2101/02* (2013.01)

(56) References Cited

U.S. PATENT DOCUMENTS

| | | | |
|---|---|---|---|
| 2009/0187234 | A1 | 7/2009 | Meyer |
| 2011/0176091 | A1 | 7/2011 | Boonekamp |
| 2012/0013238 | A1 | 1/2012 | Jonsson |

FOREIGN PATENT DOCUMENTS

| | | | |
|---|---|---|---|
| WO | WO2010115345 | A1 | 10/2010 |
| WO | WO2011033394 | A1 | 3/2011 |
| WO | WO2011033431 | A1 | 3/2011 |

ADJUSTABLE LIGHT EMITTING ARRANGEMENT FOR ENHANCEMENT OR SUPPRESSION OF COLOR USING A WAVELENGTH CONVERTING MEMBER AND A NARROW BAND REFLECTOR

CROSS-REFERENCE TO PRIOR APPLICATIONS

This application is a U.S. national stage application under 35 U.S.C. §371 of International Application No. PCT/IB2013/051600, filed on Feb. 28, 2013, which claims priority benefit under 35 U.S.C. §119(e) of U.S. Provisional Application No. 61/608,705 filed on Mar. 9, 2012, the contents of which are herein incorporated by reference.

FIELD OF THE INVENTION

The present invention relates to solid state light source based arrangements having a spectrum-adjustable light output.

BACKGROUND OF THE INVENTION

In many instances such as retail or trade fairs it is desirable to present articles, e.g. fresh food, in an attractive way. With regard to illumination, this usually means that the colors of the articles should be enhanced.

Conventionally, compact high intensity discharge lamps, such as ultra high pressure sodium lamps (e.g. SDW-T lamps) or special fluorescent lamps are used for this purpose. In the case of light sources showing more continuous spectrum an additional filter is often used to obtain the required spectrum, leading however to low system efficacy. Additional drawbacks of these conventional light sources are relatively low efficacy and short lifetimes.

A light emitting diode (LED) based solution can in principle be used to overcome the above disadvantages. By combining light emitting diodes (LEDs) having different spectral output in the desired proportion, e.g. blue, green, amber and red, a total spectral output giving saturation of certain colors can be obtained. However, it is difficult to produce LEDs with a desired emission maximum. Other drawbacks of current LED based solutions are low efficiency and complexity of the system, as the use of differently colored LEDs leads to complex binning issues. Moreover, to maintain color point stability a complex control system is required, since particularly red LEDs exhibit strong changes in output spectra with current and temperature. As a result, the cost of the lamp is high.

In general lighting applications, some disadvantages of systems with LEDs of different colors can be overcome by using only blue LEDs and conversion of part of the blue light by a wavelength converting material (also referred to as a phosphor) to obtain white light output. However, a drawback of many blue light converting phosphors with regard to specialised illumination applications is that they generally exhibit a broad emission spectrum, and thus high saturation of colors cannot be achieved.

Furthermore, the known systems described above provide a predetermined light spectrum which may be suitable for enhancement of one or a few colors, at most. In retail environments, optimal illumination of all objects typically requires many different spectral compositions. For example, for illumination of fruit and vegetables green-enhanced (greenish) white light is desirable, and for cheese and meat yellow-enhanced and red-enhanced white light is desirable, respectively. Furthermore, for illumination of fish a cool white light is preferred, whereas for bread a warm white light gives the most visually appealing impression. Today there is no single system that can be used for optimal illumination of such differently colored articles.

US 2011/0176091 discloses a device having a variable color output. The device comprises an LED arranged in a light chamber, a luminescent element (phosphor), and an electrically variable scattering element, by which the color point and the correlated color temperature of the emitted light may be varied. The device may be adjusted to emit cool white light or warm white light. However, notwithstanding the disclosure of US 2011/0176091, there remains a need in the art for improved, color adjustable devices.

SUMMARY OF THE INVENTION

It is an object of the present invention to overcome this problem, and to provide a light emitting arrangement which can easily be adapted to produce a desirable output light spectrum, capable of enhancing various colors.

According to a first aspect of the invention, this and other objects are achieved by a color-adjustable light emitting arrangement, comprising

- a solid-state light source adapted to emit light of a first wavelength range;
- a wavelength converting member arranged to receive light of said first wavelength range emitted by the light source and capable of converting light of the first wavelength range into visible light of a second wavelength range;
- a narrow band reflector arranged in a light output direction from the wavelength converting member to receive light of said second wavelength range, said narrow band reflector being reversibly switchable between a first state in which the narrow band reflector reflects a first sub-range of said second wavelength range, and a second state in which the narrow band reflector has a different optical property. The optical property is typically a reflection property.

The spectral output of the light emitting arrangement of the invention can easily be adjusted as desired with respect to the intended application, e.g. the object to be illuminated. Thus, enhancement or suppression of any color may be achieved and controlled. Typically, the second wavelength range represents the visible light spectrum (from 400 to 800 nm).

In an embodiment, the narrow band reflector in the second state is transmissive to light of all wavelengths of the second wavelength range. In other embodiments, in the second state the narrow band reflector reflects a second sub-range of the second wavelength range. Typically said first sub-range and said second sub-range are different from each other. Preferably the first and the second sub-ranges do not overlap. The reflection band width of the narrow band reflector in said first state, and optionally also in said second state (i.e. the width of the sub-range R1 and optionally also the sub-range R2), may be 100 nm or less, preferably 50 nm or less. Thus, very fine tuning of the light output spectrum is possible.

In some embodiment, the narrow band reflector may comprise a plurality of regions having different reflection properties. For example, the narrow band reflector may comprise a plurality of in-plane regions having different reflection properties, and the narrow band reflector may be arranged such that at least two in-plane regions can simultaneously receive light emitted by the solid state light source. In other embodiments, the narrow band reflector may comprise at least two narrow band reflectors or narrow band reflector layers having different reflection properties, arranged in the path of light from the wavelength converting member in a light output direction. At least two narrow band reflectors or narrow band reflector layers may each be independently switchable between a first state and a second state. All of these embodiments increase the number of potential output spectra and thus increase the adaptability and versatility of the color-adjustable light emitting arrangement.

In embodiments of the invention, the narrow band reflector may be mechanically switchable between said first state and said second state, by changing the position of at least one of said regions relative to the wavelength converting member. Alternatively, in other embodiments a reflection property of the narrow band reflector or a region thereof may be adjustable by application of an electric field, such that the narrow band reflector is electrically switchable between said first state and said second state. For example, an electrically switchable narrow band reflector may comprise an electrically controllable liquid crystal cell, an electrically controllable thin film roll-blind, and/or an electrically controllable electrochromic layer.

In some embodiments, the light emitting arrangement further comprises a diffuser, or an angled diffuse reflector, arranged in the path of light from the narrow band reflector in the light output direction. A diffuser may improve the light distribution and homogeneity of the output light. A diffuser may be particularly advantageous in combination with an electrically switchable narrow band reflector as described above.

In further embodiments, the light emitting arrangement may comprise a light mixing chamber arranged in the path of light from the narrow band reflector in the light output direction. The light mixing chamber provides recycling of light and may further improve light distribution and homogeneity.

In some embodiments, the light emitting arrangement may further comprise a light sensor arranged to detect the spectral composition of light transmitted by the narrow band reflector. The light sensor is typically connected to a control device for electrically controlling said switching of the narrow band reflector between said first state and said second state. Thus, narrow band reflector may be automatically adjusted to provide a predetermined, desirable spectral composition of output light. Alternatively or additionally, in some embodiments the light emitting arrangement may comprise a light sensor arranged to detect the spectral composition of light outside of the light emitting arrangement, and connected to a control device for electrically controlling said switching of the narrow band reflector between said first state and said second state. As a result, the narrow band reflector, and hence also the output light, may be automatically adjusted based on the reflective properties of an illuminated object.

In another aspect, the invention relates to a luminaire comprising a light emitting arrangement as described herein.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
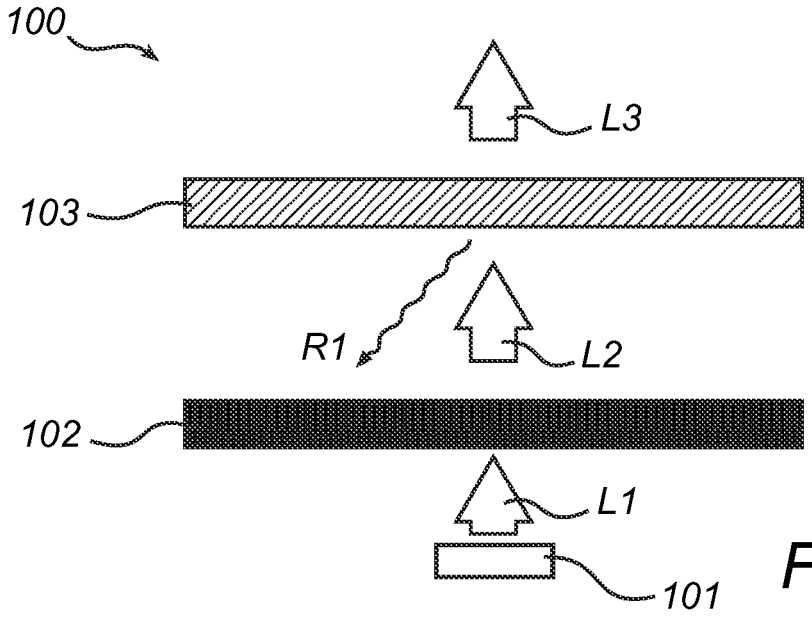
FIGS. 1*a-b* illustrate the general concept of a color adjustable light emitting arrangement (side view) according to the invention.
Figure 1B:
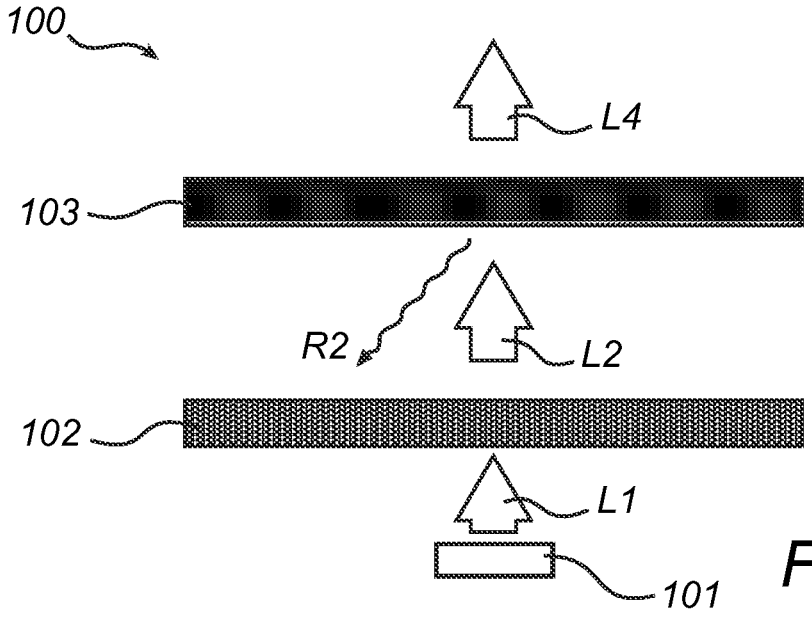

FIGS. 1*a* and 1*b* illustrate the general structure of a light emitting arrangement according to embodiments of the invention. The light emitting arrangement 100 comprises a light source 101 arranged on a suitable support (not shown). In the light output direction from the light source, but at a certain distance from the light source, a wavelength converting member 102 is provided. On the opposite side of the wavelength converting member in relation to the light source (i.e., downstream in the path of light) a narrow band reflector 103 is provided.

During operation, the light source emits light L1 of a first wavelength range, for example blue light. The light L1 is received by the wavelength converting member, which converts at least part of the light L1 into light of a second wavelength range, denoted L2. Light L2 is received by the narrow band reflector 103. In a first state, illustrated using as a line screen in FIG. 1*a*, the narrow band reflector 103 transmits most of the light of the second wavelength range L2, except for a narrow sub-range R1 which is reflected. Hence, in the first state the narrow band reflector transmits light L3 (L3=L2−R1).

FIG. 1*b* illustrates the light emitting arrangement 100 in which the narrow band reflector 103 has been switched into its second state, represented by a dense screen pattern in FIG. 1*b*. In the second state, the narrow band reflector reflects a narrow sub-range R2 instead of the range R1. Thus, in the second state the total emitted light L4 from the light emitting arrangement differs in spectral composition from the light L3 emitted while in the first state (L4=L2−R2).

Typically, in the first state, light of the wavelength range R2 may be transmitted while light of the range R1 is reflected. Similarly, in the second state, light of the wavelength range R1 may be transmitted, while light of the range R2 is reflected.

Figure 2A:
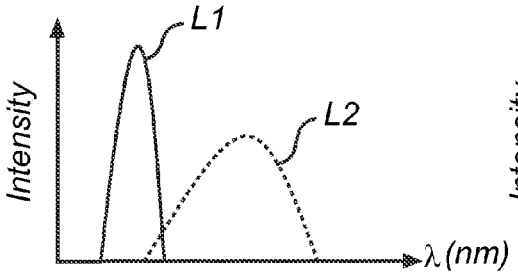
FIGS. 2*a-c* and 3*a-c* are graphs illustrating exemplary light intensity at different wavelengths for light L1, L2, L3, L4, R1 and R2 as shown in FIG. 1*a-b*.
Figure 3A:
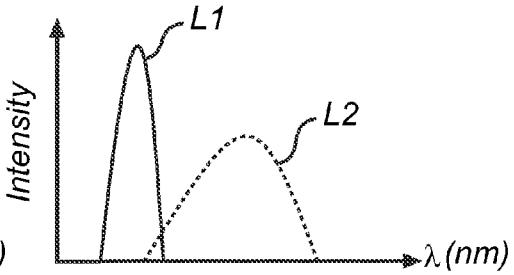

FIGS. 2*a-c* and FIGS. 3*a-c* schematically illustrate exemplary spectral compositions of the light produced by a light-emitting arrangement according to embodiments of the invention. FIGS. 2*a* and 3*a* each illustrate the light intensity spectra of the light L1 emitted by the light source 101 and the converted light L2 produced by the wavelength converting member 102.

Figure 2B:
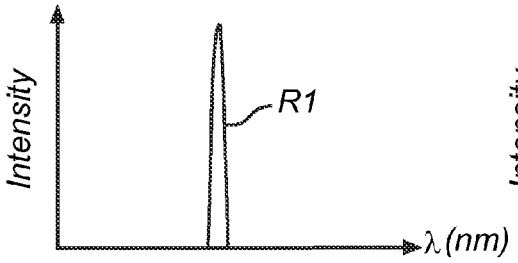
Figure 2C:
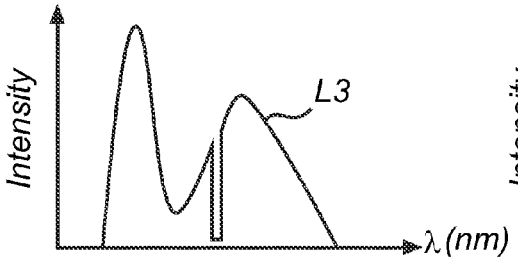

FIG. 2*b* illustrates the light intensity spectrum of the light R1 reflected by the narrow band reflector 103 in the first state. FIG. 2*c* illustrates the light intensity spectrum of the light L3 exiting from the light emitting arrangement after being transmitted by the narrow band reflector in the first state. As can be seen, the output spectrum is deficient in wavelengths corresponding to the light R1 reflected by the narrow band reflector. A light emitting arrangement having this particular output spectrum may be used for enhancing yellow colors, at the expense of green color. Hence, in the first state, the light emitting arrangement may be suitable for illuminating yellow objects, such as bananas.

Figure 3B:
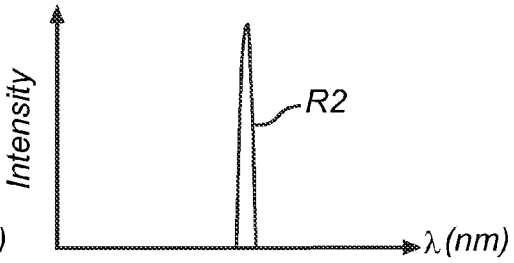
Figure 3C:
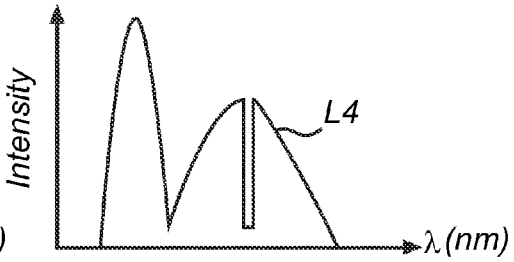

In contrast, FIG. 3*b* illustrates the light intensity spectrum of the light R2 reflected by the narrow band reflector 103 in the second state. Accordingly, FIG. 3*c* illustrates the light intensity spectrum of the light L4 exiting from the light emitting arrangement after being transmitted by the narrow band reflector in the second state. As can be seen, the output spectrum is deficient in wavelengths corresponding to the light R2 reflected by the narrow band reflector. Thus, in the second state, the light emitting arrangement may be used, optionally in combination with a filter, for enhancing the color of red objects, such as tomatoes.

The narrow band reflector 103 is reversibly switchable between the first state, in which it reflects light of a first sub-range R1, and a second state, in which it may reflect light of a second sub-range R2. The first and second sub-ranges are typically narrow ranges within the visible light spectrum. The band width of the sub-ranges reflected by the narrow band reflector is typically 100 nm or less, and preferably 50 nm or less. Hence, the sub-range R1, and optionally also the sub-range R2, typically does not extend over more than 100 nm, preferably not over more than 50 nm.

Figure 4A:
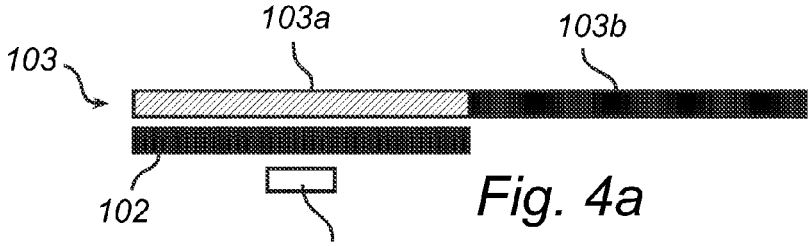
FIGS. 4*a-b* show schematic side views of an embodiment comprising a mechanically switchable narrow band reflector.
Figure 4B:
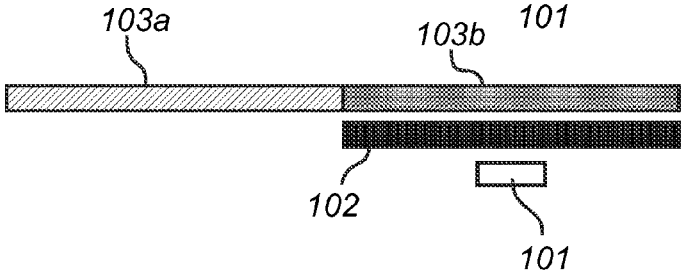

The switching between said first and second states may be performed by a user and is typically done with regard to the particular object to be illuminated. The switching may be mechanical or electrical. FIG. 4*a-b* illustrate the concept of mechanical switching. In FIG. 4*a*, the narrow band reflector 103 is in the first state. The narrow band reflector of mechanically switchable embodiments typically comprise two portions 103*a*, 103*b* having different reflective properties. In particular, the portion 103*a* is capable of reflecting light of a first sub-range, represented by R1. Hence, as seen in FIG. 4*a*, when the portion 103*a* is positioned in the light output direction from the light source and the wavelength converting member (here in front of the wavelength converting member), the narrow band reflector is said to be in the first state. The second portion 103*b*, on the other hand, is capable of reflecting light of a different sub-range, represented by R2. As shown in FIG. 4*b*, when the second portion 103*b*, rather than the first portion 103*a*, is positioned in the light output direction from the light source and the wavelength converting member, the narrow band reflector is said to be in the second state. The narrow band reflector may be mechanically shifted, e.g. laterally slid, between the two positions illustrated respectively in FIG. 4*a* an FIG. 4*b*.

Figure 5A:
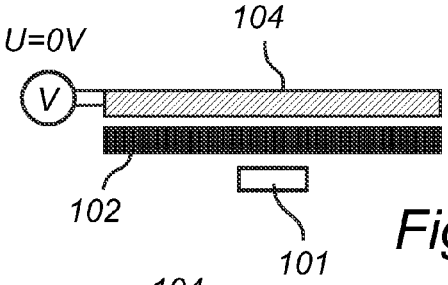
FIGS. 5*a-b* show schematic side views of an embodiment comprising an electrically switchable narrow band reflector.
Figure 5B:
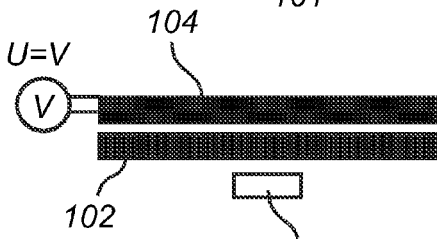

A different concept for switching the narrow band reflector between the first state and the second state is represented by FIG. 5*a-b*. In such embodiments, the narrow band reflector comprises a material having electrically controllable properties, often electrically controllable optical properties. Further details and examples will be given below. The narrow band reflector 104 is connected to a voltage source. In the absence of an applied voltage (U=0) the narrow band may be either equally transmissive to all visible wavelengths, or may reflect a first sub-range R1 of visible light. Thus, at no applied voltage, the narrow band reflector is in the first stage. Upon application of a voltage, represented by FIG. 5*b*, the narrow band reflector instead reflects light of another sub-range, R2. Thus, at an applied voltage the narrow band reflector is in the second state. Alternatively, in the absence of an applied voltage the narrow band reflector 104 may reflect a first subrange, and in response to an applied voltage it may become transmissive.

Furthermore, it is contemplated that the narrow band reflector could have different reflective properties at different voltages, such that it could be in a third state reflecting light of a third sub-range R3, a fourth state reflecting light of a fourth sub-range R4, etc., at different voltages.

Figure 6:
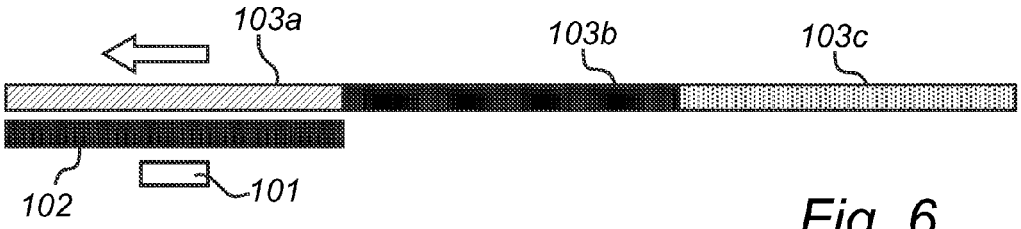
FIG. 6 shows a schematic side view of another embodiment comprising a mechanically switchable narrow band reflector.

FIGS. 6-10 illustrate various embodiments utilizing mechanical switching between the first and the second states, and optionally a third state, a fourth state, etc. As illustrated in FIG. 6, the narrow band reflector 103 may comprise three portions 103*a*, 103*b*, 103*c* having different reflective properties and each representing a state, in which a particular sub-range is reflected. Hence, using such a narrow band reflector, the narrow band reflector may have at least three states. It is also possible that a mechanically switchable narrow band reflector may be partly switched between the first and second positions, or between the second and third positions, thus providing many possible intermediate positions (representing additional states).

A mechanically switchable narrow band reflector may comprise optical filters, such as interference filters or dichroic filters, photonic gap materials, etc.

Figure 7:
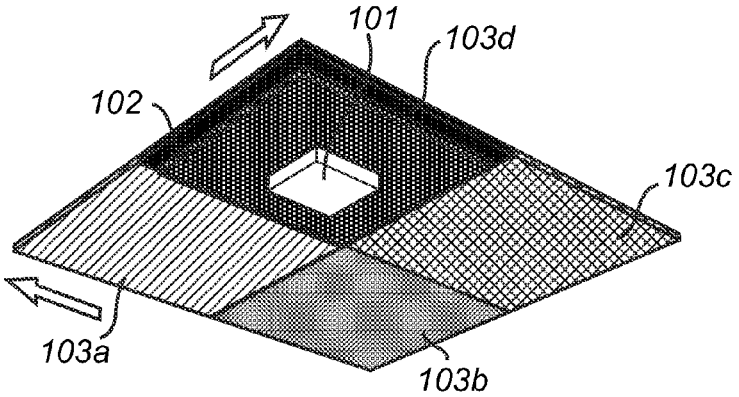
FIG. 7 shows a schematic perspective view of another embodiment comprising a mechanically switchable narrow band reflector

FIG. 7 is a perspective view of a light emitting arrangement having four different portions 103*a*, 103*b*, 103*c*, 103*d*, and which may be mechanically shifted such that each of said portion may be positioned in the light output direction from the light source and the wavelength converting member.

Figure 8:
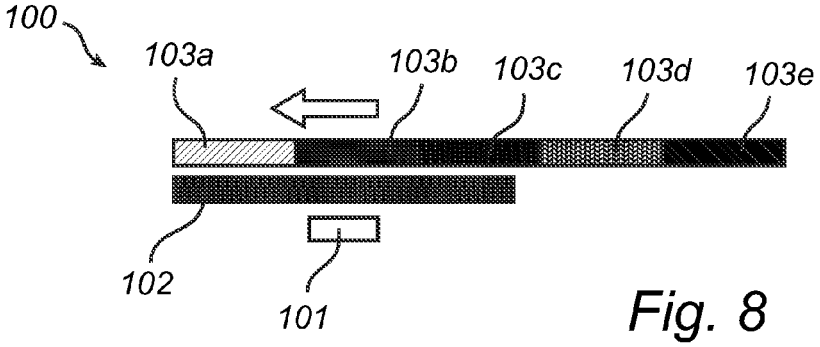
FIG. 8 shows a schematic side view of another embodiment comprising a mechanically switchable narrow band reflector.

FIG. 8 shows an embodiment of a light emitting arrangement comprising a so-called pixilated narrow band reflector. In this embodiment, the narrow band reflector comprises a plurality of portions 103*a*, 103*b*, 103*c*, 103*d*, 103*e* having different reflective properties. At least two, for example at least three (as illustrated in FIG. 8) portions may simultaneously be positioned in the light output direction from the light source and the wavelength converting member. Thus, in the first state, the narrow band reflector may reflect light of a plurality (e.g., two or three) of sub-ranges. In such embodiments, in the second and any further state, the narrow band reflector may reflect light of a second plurality of sub-ranges which is different from the first or any foregoing state with respect to at least one sub-range. It is envisaged that also the narrow band reflector of FIG. 4*a*-*b*, FIG. 6 and FIG. 7 could be partially shifted such that part of two portions 103*a*, 103*b* are simultaneously positioned in the light output direction from the light source and the wavelength converting member, such that in a third state the light reflected from the narrow band reflector comprises two sub-ranges R1 and R2, optionally in different proportions with respect to the amount (intensity) reflected. For the embodiment of FIG. 6, a fourth state could represent parts of portions 103*b*, 103*c* both being positioned in the light output direction from the light source and the wavelength converting member, in which fourth state light of a first sub-range R2 as well as a third sub-range R3 may be reflected.

Figure 9:
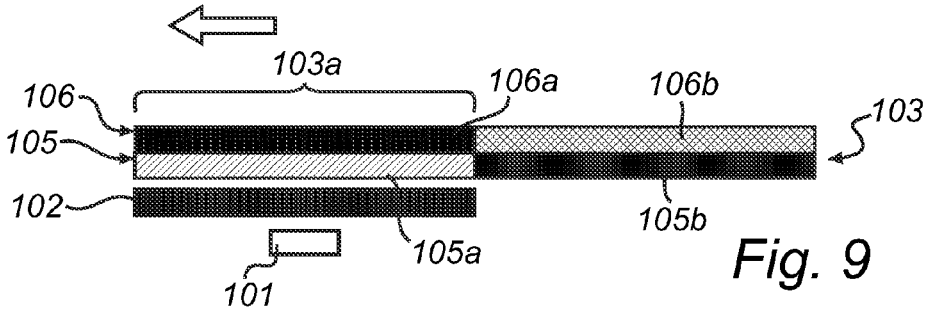
FIG. 9 shows a schematic side view of another embodiment comprising a mechanically switchable narrow band reflector.

In another embodiment, illustrated in FIG. 9, the narrow band reflector comprises at least two layers 105, 106 stacked in the light output direction having different reflective properties. Thus, a portion 103*a* of the narrow band reflector may comprise a layer 105*a* and a layer 106*a*. Similarly, a portion 103*b* may comprise a layer portion 105*b* and a layer portion 106*b*. The layer portions 105*a*, 105*b* may have the same or different reflective properties. Also the layer portions 106*a*, 106*b* may have the same or different reflective properties. Usually however there is some difference in reflective properties between at least one of 105*a*-105*b* and 106*a*-106*b*.

Figure 10:
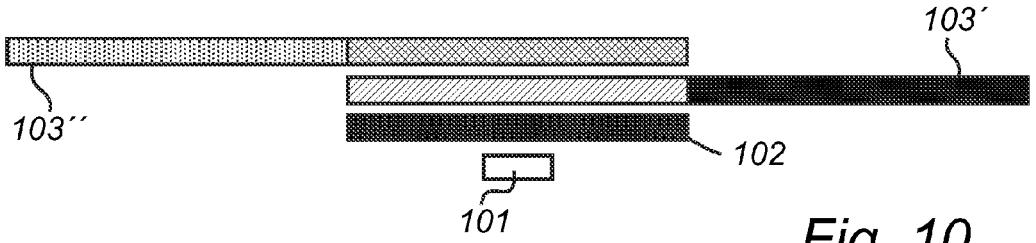
FIG. 10 shows a schematic side view of another embodiment comprising a mechanically switchable narrow band reflector.

In yet another embodiment, illustrated in FIG. 10, instead of using a narrow band reflector consisting of a layer stack, two narrow band reflectors 103', 103" may be used, arranged in the light output direction from the light source and the wavelength converting member. Each of the narrow band reflectors 103', 103" comprises at least two portions as described above having different reflective properties. The narrow band reflectors 103', 103" may be independently shifted between different positions. Hence, any combination of portions positioned in front of the wavelength converting member may represent a state in which light of particular sub-range(s) is reflected. For example, when each of the narrow band reflectors 103', 103" comprises two portions, the narrow band reflectors may provide at least four different states. The narrow band reflectors 103', 103" do not necessarily have the same number, or the same pattern, of portions with different reflective properties. Each of the reflectors 103', 103" may be as described with reference to any one of FIG. 4*a*-*b*, FIG. 6, FIG. 7 or FIG. 8.

Further embodiments utilizing electrical switching will now be described with reference to FIG. 11, FIG. 12 and FIG. 13*a*-*b*.

Figure 11:
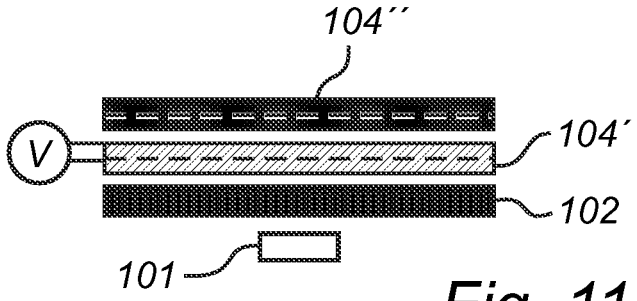
FIG. 11 shows a schematic side view of another embodiment comprising an electrically switchable narrow band reflector.
Figure 12:
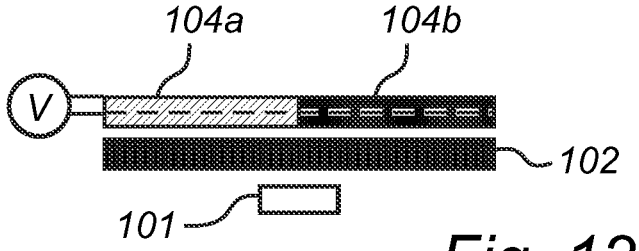
FIG. 12 shows a schematic side view of another embodiment comprising an electrically switchable narrow band reflector.

FIG. 11 illustrates a light emitting arrangement comprising a stack of two electrically controllable narrow band reflectors 104', 104". The narrow band reflectors 104', 104" may be independently controllable and connected to separate voltage sources. Alternatively, as illustrated in FIG. 12, an electrically switchable narrow band reflector may comprise different, optionally independently controllable, portions 104*a*, 104*b*. Each of said portions 104*a*, 104*b* is connected to a voltage source. It is envisaged that a narrow band reflector may have a repetitive pattern of at least two types of regions 104*a*, 104*b*, thus forming a pixilated narrow band reflector.

In embodiments of the invention, the electrically switchable narrow band reflector may comprise a material having electrically controllable optical properties. Examples include liquid crystal materials and electrochromic materials. For example, in some embodiments, the narrow band reflector may be a liquid crystal cell, comprising a liquid crystal material, for example a cholesteric liquid crystal material, sandwiched between to optically transparent electrodes connected to a voltage source. Upon the application of an electric field, the liquid crystal molecules are switched from a transmissive state to a reflective state, or vice versa.

In an example embodiment, an electrically switchable narrow band reflector comprises a cholesteric liquid crystal material, typically a gel. Cholesteric liquid crystal materials can be switched between transmissive and reflective states. Cholesteric liquid crystals, also known as chiral nematic liquid crystals, are formed of layers of molecules with varying director axes, resulting in a helical structure. The reflected wavelength depends on the pitch of the helix. The pitch of a cholesteric liquid crystal material may depend on the type of molecule and may additionally in some cases be controlled during manufacture by UV exposure conditions. Advantageously, a cholesteric liquid crystal gel may be used to for a pixilated narrow band reflector having a repeated pattern of at least two types of regions 104*a*, 104*b* having different reflective properties (typically capable of reflecting different wavelengths).

Alternatively, in embodiments on the invention, an electrically switchable narrow band reflector may comprise a photonic crystal. Photonic crystal structure or particles which are stacked in a uniform pattern cause interference of light when light is deflected by the structures or particles. As a result, certain wavelengths of light are reflected. The reflection and transmission properties of a photonic crystal structure may be tuned by varying the distances between adjacent structures or particles. Said distances may be varied in response to an electric field and hence the reflection properties may be electrically controlled using a voltage source. For example, a photonic crystal structure such as photonic ink can be electrically controlled by applying increasing voltage (e.g. from 0 V to about 2 V) to reflect any wavelength of the visible spectrum.

Alternatively, an electrically switchable narrow band reflector 104 may comprise an electrochromic material.

Figure 13A:
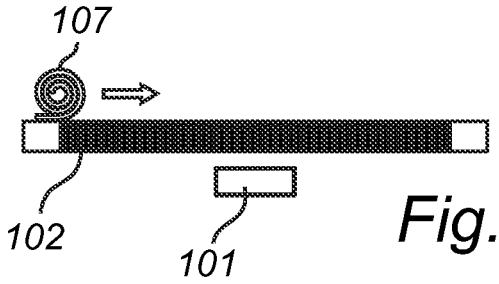
FIGS. 13*a-b* show schematic side views of another embodiment comprising an electrically switchable narrow band reflector in the form of an electrically controllable roll-up blind.
Figure 13B:
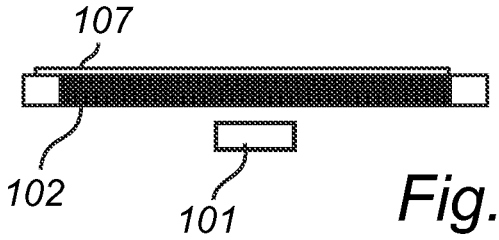

In other embodiments, an electrically switchable narrow band reflector may comprise an electrically controllable roll-blind device 107. Such a roll-blind device may be arranged directly on the wavelength converting member as shown in FIG. 13*a*-*b*.

Electrically controlled roll-blinds, or rollable electrodes, are known in the art. Typically, such a device comprises a planar substrate on which is arranged a first transparent electrode layer connected to a voltage source (not shown). An insulating transparent dielectric layer is arranged over the first transparent electrode. The roll-blind comprises a flexible optically functional layer, typically formed of a self-supporting film. On the side of the roll-blind intended to face the dielectric layer, the optically functional layer is coated with a second electrode layer. The roll-blind has a naturally rolled-up configuration and may be reversibly unrolled in response to the application of an electric potential. In the unrolled, planar configuration the roll-blind covers a larger part of the substrate compared to its rolled-up configuration. When the electric potential is removed, the roll-blind reassumes its original rolled-up configuration due to inherent stress. In the context of the present invention, the flexible optically functional layer has reflective properties such that in the unrolled state, the roll-blind reflects light of a sub-range R1.

In embodiments comprising an electrically switchable narrow band reflector, the light emitting arrangement typically also comprises control means connected to the voltage source, enabling a user to manually or automatically control the voltage supplied to the electrically switchable narrow band reflector and hence control the switching thereof.

The light emitting arrangement may comprise further optical elements, e.g. a reflector, a diffuser, a lens, a light mixing chamber, etc. For example, in some embodiments the light emitting arrangement may comprise a collimator arranged between the wavelength converting member and the narrow band reflector in order to select the angular distribution of light to be received by the narrow band reflector.

Figure 14:
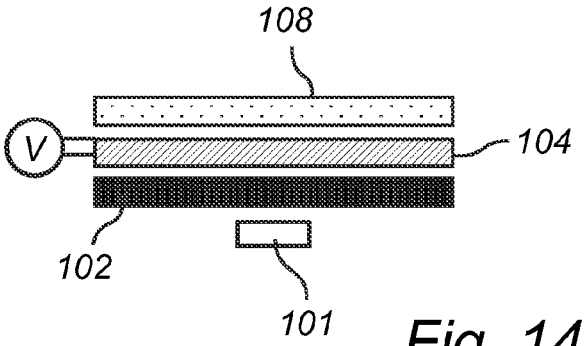
FIG. 14 shows a schematic side view of an embodiment comprising an electrically switchable narrow band reflector and a diffuser.
Figure 16:
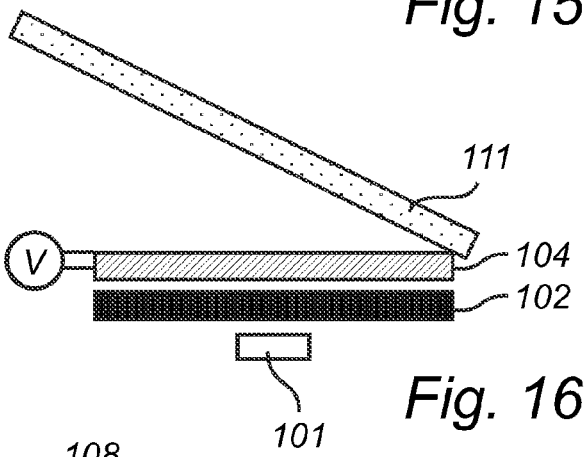
FIG. 16 shows a schematic side view of an embodiment comprising an electrically switchable narrow band reflector and an angled diffuse reflector.

In particular, in some embodiments the light emitting arrangement may comprise at least one diffuser 108 arranged in the path of light in the output direction from the narrow band reflector, as shown in FIG. 14. The diffuser 108 may be any suitable diffuser known in the art. Examples of suitable diffusers include plastic diffusers comprising scattering particles, such as particles of $TiO_2$ or $Al_2O_3$, or pores or cavities, and substrates having surface structures adapted to diffuse light. Alternatively, instead of a transmissive diffuser, a diffuse reflector 111 may be used. The diffuse reflector may be angled with respect to the narrow band reflector, as shown in FIG. 16.

Figure 15:
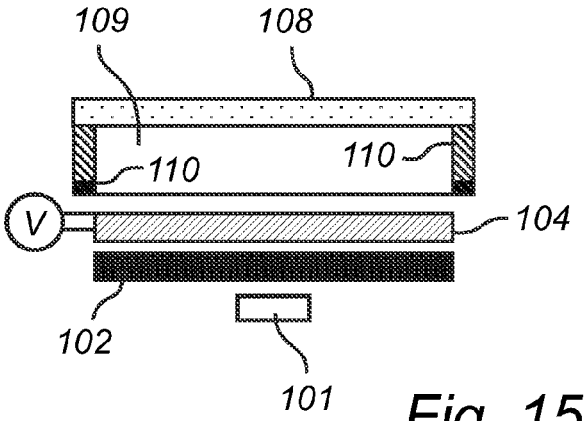
FIG. 15 shows a schematic cross-sectional side view of an embodiment comprising an electrically switchable narrow band reflector, a light mixing chamber and a diffuser.

In embodiments of the invention, shown in FIG. 15, the light emitting arrangement may comprise a light mixing chamber 109 provided in the light output direction from the narrow band reflector. The light mixing chamber is defined by at least one reflective wall 110, and a light exit window in which a diffuser 108 is arranged.

It is noted that a diffuser, a diffuse reflector and/or a light mixing chamber may also be used in combination with a mechanically switchable narrow band reflector instead of the electrically switchable narrow band reflector 104.

Figure 17:
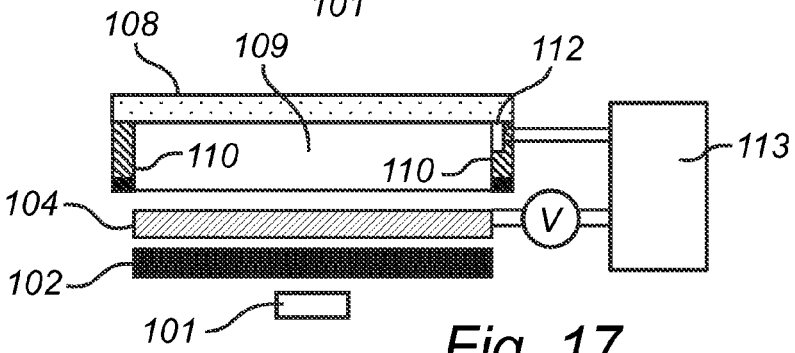
FIG. 17 shows a schematic cross-sectional side view of an embodiment comprising an electrically switchable narrow band reflector and a light sensor connected to the electrically switchable narrow band reflector via a control device.

In order to provide increased adjustability and improved spectrum tuning, the light emitting arrangement may further comprise a light sensor measuring the spectral composition of the light exiting the narrow band reflector. For example, a light sensor 112 may be arranged to measure light within a light mixing chamber 109, as shown in FIG. 17. The light sensor 112 may be connected to and communicate with a control device 113, which, in turn, is connected to and may control the voltage source supplying voltage to the electrically switchable narrow band reflector 104. Thus, narrow band reflector may be automatically adjusted to achieve a preset, desirable spectral composition.

In some embodiments, the light emitting arrangement may further comprise an external light sensor adapted to measure the light spectrum outside of the light emitting arrangement, including the light reflected from an object illuminated, or intended to be illuminated, by the light emitting arrangement. The second light sensor may be connected to a control device which in turn is connected to and may control the voltage source responsible for switching of the narrow band reflector. This control device may be the same control device 113 to which the light sensor 112 is connected. Hence, the narrow band reflector, and hence the output light, may be automatically adjusted also based on the reflective properties (color) of an illuminated object.

The light source of the light emitting arrangement of the invention is typically a solid state light source, such as a light emitting diode (LED), an organic light emitting diode (OLED) or a laser diode. Preferably the light of the first wavelength range emitted by the light source is in the wavelength range of from about 300 nm to about 500 nm. In some embodiments the light source is a blue light emitting LED, such as GaN or InGaN based LED.

The wavelength converting member is chosen with due regard to the emission wavelength of the light source. The wavelength converting member is typically arranged at a remote position with respect to the light source (so-called remote phosphor configuration), but it is also contemplated that the wavelength converting member may be arranged directly on or near the light source, so-called vicinity configuration.

The wavelength converting member comprises at least one luminescent material. In embodiments of the invention, the wavelength converting member may comprise a plurality of wavelength converting members, combined in a single body or separated to form distinct regions having different wavelength converting properties. For example, the wavelength converting member may comprise a plurality of stacked wavelength converting layers each comprising at least one luminescent material. Alternatively, the wavelength converting member may comprise a plurality of in-plane regions of at least two types comprising different luminescent materials or different composition of luminescent materials (so-called pixilated phosphor).

The luminescent material may be an inorganic phosphor material, an organic phosphor material, and/or quantum dots. Examples of inorganic wavelength converting materials may include, but are not limited to, cerium (Ce) doped YAG ($Y_3Al_5O_{12}$) or LuAG ($Lu_3Al_5O_{12}$). Ce doped YAG emits yellowish light, whereas Ce doped LuAG emits yellow-greenish light. Examples of other inorganic phosphors materials which emit red light may include, but are not limited to ECAS (ECAS, which is $Ca_{1-x}AlSiN_3:Eu_x$ wherein $0<x\leq1$; preferably $0<x\leq0.2$) and BSSN (BSSNE, which is $Ba_{2-x-z}M_xSi_{5-y}Al_yN_{8-y}O_y:Eu_z$ wherein M represents Sr or Ca, $0\leq x\leq1$ and preferably $0\leq x\leq0.2$, $0\leq y\leq4$, and $0.0005\leq z\leq0.05$). Examples of suitable organic wavelength converting materials are organic luminescent materials based on perylene derivatives, for example compounds sold under the name Lumogen® by BASF. Examples of suitable compounds include, but are not limited to, Lumogen® Red F305, Lumogen® Orange F240, Lumogen® Yellow F083, and Lumogen® F170.

An organic or a particular inorganic wavelength converting material is typically contained in a carrier material, typically a polymeric matrix. In the case of particular inorganic phosphors, the phosphor particles may be dispersed in the carrier material. In the case of organic luminescent materials, the organic luminescent material is typically molecularly dissolved in the carrier. Examples of suitable carrier materials include polymethyl methacrylate (PMMA), polyethylene terephthalate (PET), polyethylene naphthalate (PEN), and polycarbonate (PC).

In some embodiments, the wavelength converting material may comprise quantum dots or quantum rods. Quantum dots are small crystals of semiconducting material generally having a width or diameter of only a few nanometers. When excited by incident light, a quantum dot emits light of a color determined by the size and material of the crystal. Light of a particular color can therefore be produced by adapting the size of the dots. Most known quantum dots with emission in the visible range are based on cadmium selenide (CdSe) with shell such as cadmium sulfide (CdS) and zinc sulfide (ZnS). Cadmium free quantum dots such as indium phosphide (InP), and copper indium sulfide ($CuInS_2$) and/or silver indium sulfide ($AgInS_2$) can also be used. Quantum dots show very narrow emission band and thus they show saturated colors. Furthermore the emission color can easily be tuned by adapting the size of the quantum dots. Hence, in embodiment of the present invention quantum dots may be used for producing light having narrow emission band(s), i.e. light of second wavelength range which is rather narrow, or a plurality of narrow ranges. In such embodiment, the narrow band reflector may reflect a substantial part of the second wavelength range to produce output light having a narrow, well defined color composition.

Any type of quantum dot known in the art may be used in the present invention, provided that it has the appropriate wavelength conversion characteristics. However, it may be preferred for reasons of environmental safety and concern to use cadmium-free quantum dots or at least quantum dots having a very low cadmium content.

The light emitting arrangement of the present invention may be useful in a luminaire, e.g. to be mounted in an overhead position, on a wall or ceiling, or suspended, for special illumination of objects in commercial environments, such as retail stores, exhibitions, etc., or for artistic or decorative purposes.

The person skilled in the art realizes that the present invention by no means is limited to the preferred embodiments described above. On the contrary, many modifications and variations are possible within the scope of the appended claims. For example, the light emitting arrangement may comprise a plurality of light sources, each light source associated with a separate wavelength converting member and/or narrow band reflector. Alternatively, a plurality a light sources may be arranged such that a single wavelength converting member receives light emitted by a plurality of light sources.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A color adjustable light emitting arrangement, comprising a solid-state light source adapted to emit light of a first wavelength range;

a wavelength converting member arranged to receive light of said first wavelength range emitted by the light source and capable of converting light of the first wavelength range into visible light of a second wavelength range;

a narrow band reflector arranged in a light output direction from the wavelength converting member to receive light of said second wavelength range, said narrow band reflector being reversibly switchable between a first state in which the narrow band reflector reflects a first sub-range of said second wavelength range, and a second state in which the narrow band reflector reflects a second sub-range of the second wavelength range.

2. A light emitting arrangement according to claim 1, wherein the narrow band reflector in said first state, and optionally also in said second state, has a reflection band width of 100 nm or less.

3. A light emitting arrangement according to claim 1, wherein the narrow band reflector comprises a plurality of regions having different reflection properties.

4. A light emitting arrangement according to claim 1, wherein the narrow band reflector comprises a plurality of in-plane regions having different reflection properties, and is arranged such that at least two in-plane regions can simultaneously receive light emitted by said light source.

5. A light emitting arrangement according to claim 1, wherein the narrow band reflector comprises at least two narrow band reflectors or narrow band reflector layers having different reflection properties arranged in the path of light from the wavelength converting member in a light output direction.

6. A light emitting arrangement according to claim 5, wherein said at least two narrow band reflectors are independently switchable each between a first state and a second state.

7. A light emitting arrangement according to claim 3, wherein said narrow band reflector is mechanically switchable between said first state and said second state, by changing the position of at least one of said regions relative to the wavelength converting layer.

8. A light emitting arrangement according to claim 1, wherein a reflection property of the narrow band reflector or a region thereof is adjustable by application of an electric field, such that the narrow band reflector is electrically switchable between said first state and said second state.

9. A light emitting arrangement according to claim 8, wherein the narrow band reflector comprises an electrically controllable liquid crystal cell.

10. A light emitting arrangement according to claim 8, wherein the narrow band reflector comprises an electrically controllable thin film roll-blind.

11. A light emitting arrangement according to claim 8, wherein the narrow band reflector comprises an electrically controllable electrochromic layer.

12. A light emitting arrangement according to claim 1, further comprising a light sensor arranged to detect the spectral composition of light transmitted by the narrow band reflector, and connected to a control device for electrically controlling said switching of the narrow band reflector between said first state and said second state.

13. A light emitting arrangement according to claim 1, further comprising a light sensor arranged to detect the spectral composition of light outside of the light emitting arrangement and connected to a control device for electrically controlling said switching of the narrow band reflector between said first state and said second state.

* * * * *